United States Patent [19]

Brundage et al.

[11] 4,107,635

[45] Aug. 15, 1978

[54] ARC WELDING MACHINE

[75] Inventors: Richard B. Brundage, Ladue; Walter P. Jost, Jr., Manchester; Mortimer P. Burroughs, University City, all of Mo.

[73] Assignee: Emerson Electric Co., St. Louis, Mo.

[21] Appl. No.: 747,513

[22] Filed: Dec. 6, 1976

[51] Int. Cl.[2] ..... H01F 21/06

[52] U.S. Cl. ..... 336/45; 336/133; 336/150; 336/180; 336/184; 336/197; 336/210

[58] Field of Search ..... 336/61, 130, 132, 133, 336/184, 197, 210, 120, 45, 150, 180

[56] References Cited

U.S. PATENT DOCUMENTS

| | | | |
|---|---|---|---|
| 1,036,445 | 8/1912 | Burnham | 336/184 X |
| 1,305,361 | 6/1919 | Holslag | 336/184 X |
| 1,991,400 | 2/1935 | Littmann | 336/133 |
| 2,572,457 | 10/1951 | Epstein | 336/197 X |
| 3,082,390 | 3/1963 | Peterson | 336/197 X |
| 3,237,090 | 2/1966 | Royer et al. | 336/170 X |
| 3,320,567 | 5/1967 | Hoeft | 336/197 |
| 3,447,112 | 5/1969 | Brouerman et al. | 336/197 X |
| 3,523,272 | 10/1970 | Jost et al. | 336/133 |
| 3,697,912 | 10/1972 | Solli | 336/133 |
| 3,810,303 | 5/1974 | Hoell | 336/61 X |
| 4,038,624 | 7/1977 | Namba et al. | 336/210 X |

FOREIGN PATENT DOCUMENTS

| | | | |
|---|---|---|---|
| 646,918 | 6/1937 | Fed. Rep. of Germany | 336/133 |

*Primary Examiner*—Thomas J. Kozma
*Attorney, Agent, or Firm*—Charles E. Markham

[57] ABSTRACT

An arc welder has a transformer comprising a pair of flat aligned primary coils of aluminum strip wound on opposite parallel legs of a rectangular open frame core and a pair of aligned secondary coils of the same strip material wound on the same opposite parallel core legs in lateral spaced relationship with the primary coils, a flexible strip encircles each pair of aligned coils tightly banding them against lateral distortion, a flux shunting core encapsulated in molded plastic material is slidably movable through the core between the pairs of aligned coils, and mechanism for slidably moving and locking the shunting core in adjusted positions is operated by a single handle. One secondary coil of the pair comprises two windings, one wound over the other to provide two output ranges. In a modification, the addition of an outboard choke coil of round wire provides a third output range.

10 Claims, 14 Drawing Figures

ARC WELDING MACHINE

BACKGROUND OF THE INVENTION

This invention relates to a.c. arc welders and particularly to a novel arrangement of primary and secondary transformer coils formed of relatively economical, flat, aluminum strip which achieves improved heat dissipation and coil rigidity, and to a novel and convenient means of positioning and releasably locking a flux shutting core in slidably adjusted positions to steplessly vary the current output.

Flux shunting cores to vary the transformer output are disclosed in U.S. Pat. Nos. 2,243,169, 3,394,332, and 3,523,272. U.S. Pat. Nos. 3,394,332 and 3,523,272 disclose pivotally mounted flux shunting cores, and U.S. Pat. No. 2,243,169 diagrammatically illustrates two slidably movable flux shunting cores arranged to variably shunt the flux generated by the primary coils of two adjacent transformers. Further, U.S. Pat. No. 3,523,272 discloses primary and secondary transformer coils formed of flat aluminum strip.

It has been found essential in the construction of a.c. arc welder transformers employing a novable flux shunting core that means be provided to suitably lock the movable core in adjusted positions against objectionable or even destructive vibrations at the a.c. power source frequency. It has also been found highly desirable to provide means whereby an operator may conveniently release, adjust, and adequately lock the movable shunting core with one hand and little physical effort while holding a welding electrode in the other. Moreover, it has been found that the employment of economical and relatively soft flat aluminum strip, suitable for forming the flat primary and secondary transformer coils, presents the problem of providing adequate coil rigidity to withstand vibration forces and heating under operating conditions, without lateral movement or distortion, while at the same time providing improved cooling to preclude excessive heating.

One of the objects of the invention is to provide a generally new and improved a. c. arc welder in which the primary and secondary transformer coils are formed of economical aluminum strip and in which a slidably movable flux shunting core gradually varies the output.

A further object is to provide an a.c. arc welder in which a novel arrangement of flat primary and secondary transformer coils formed of aluminum strip on a rectangular frame core provides coil rigidity, substantially improved cooling with higher current output relative to open circuit voltage, and permits the slidable adjustment of a flux shunting core between the primary and secondary coils.

A further object is to provide novel and convenient means for locking, releasing, adjustably positioning, and slidably guiding a flux shunting core.

Further objects and advantages will appear from the following description when read in connection with the accompanying drawings.

DESCRIPTION OF A PREFERRED EMBODIMENT

Figure 1:
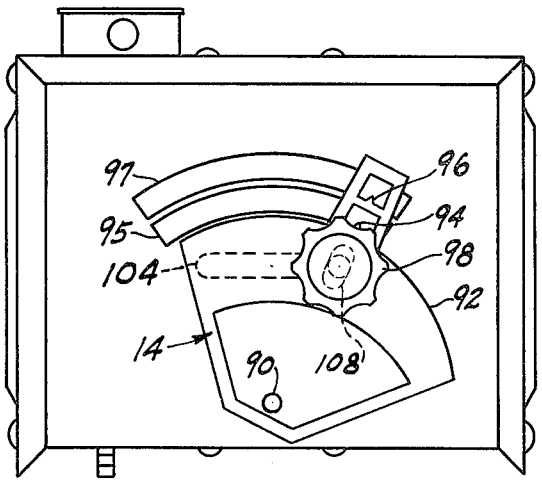
FIGS. 1, 2, and 3 are top plan, front elevational, and side elevational views, respectively, of an a.c. arc welder constructed in accordance with the present invention.

Referring now to the drawings in more detail, the arc welder includes as primary elements: a transformer assembly generally indicated at 10, a movable flux shunting core assembly 12, means indicating the position of the flux shunting core in terms of current output 14, a power source switch 16, an output plug-in receptacle panel 18, a cooling fan 20, and a casing 22.

Figure 6:
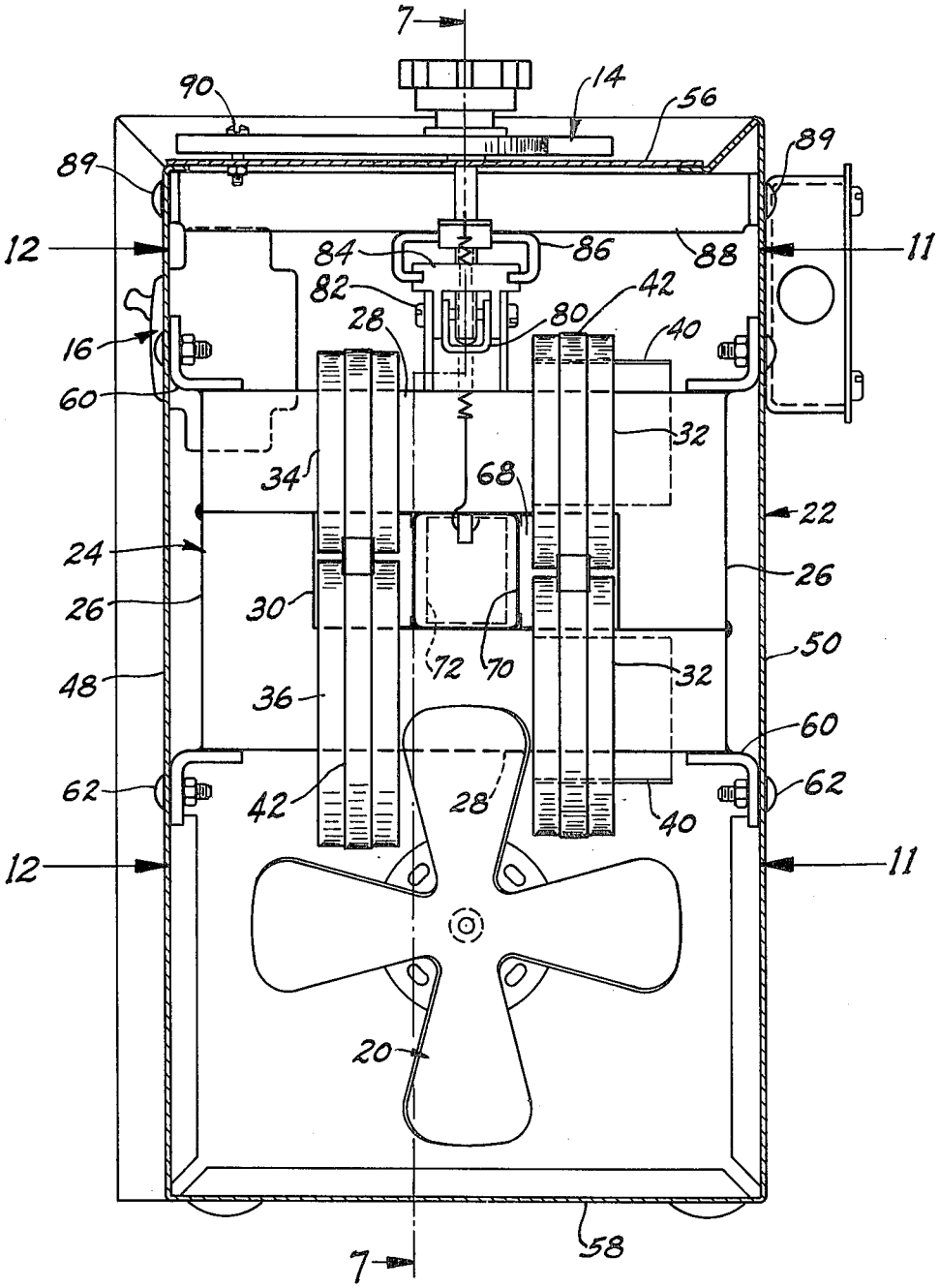
FIG. 6 is an internal side elevational view taken along line 6—6 of FIG. 2.

The transformer assembly 10 includes a rectangular laminated core 24 which may comprise two L-shaped sections welded together, resulting in two vertical legs 26, two horizontal legs 28, and a horizontally elongated window 30, see FIG. 6. Wound in vertical alignment around the upper and lower horizontal core legs 28 and closely adjacent the right-hand vertical leg 26 is a pair of flat primary coils 32. Wound in vertical alignment around the upper and lower horizontal core legs 28 and closely adjacent the left-hand vertical leg 26 is a pair of flat secondary coils 34 and 36. Upper secondary coil 34 is formed as a continuous winding, as are both primary coils 32, while lower secondary coil 36 comprises two separate windings, an inner winding **36*b* and an outer winding 36*a*, see FIGS. 11 to 14. Inner winding 36*b* when connected in series with secondary coil 34 and with outer winding 36*a***, as hereinafter described, provides additional reactance to reduce current output and thereby provides a lower range of current output.

Each of the primary coils 32 and secondary coils 34 and 36 are formed of bare aluminum strip and interleaved with fiber-glass insulating tape to form flat coils the width of the aluminum strip. Spacers 38 are provided to space the coils from the sides of the core 24. Short lengths of wider aluminum strips are interleaved between intermediate windings of the upper and lower primary coils 32 and project outward laterally, as indicated at 40 in FIG. 6, to promote heat dissipation from these coils. The total horizontal space occupied by the primary and secondary coils relative to the space between the vertical core legs 26 is such that a considerable open space remains between the adjacent sides of the right-hand primary coils and left-hand secondary coils, see FIG. 6.

Figure 11:
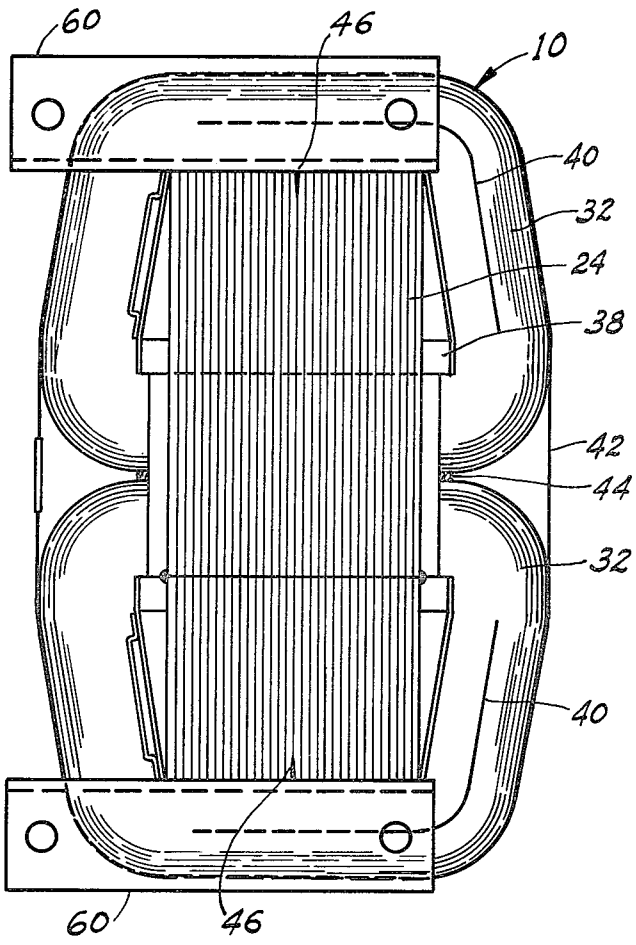
FIG. 11 is an enlarged, right-hand side, elevational view of the transformer and its mounting means, taken along line 11—11 of FIG. 6.
Figure 12:
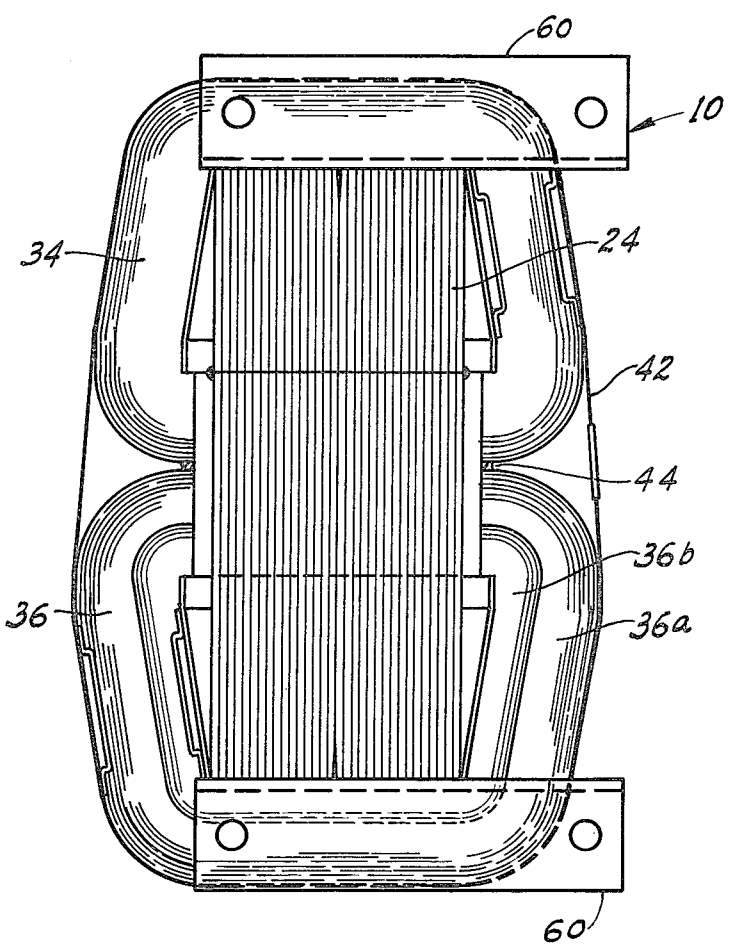
FIG. 12 is an enlarged, left-hand side, elevational view of the transformer and mounting means taken along line 12—12 of FIG. 6.

Encircling the peripheries of each of the aligned pairs of primary coils 32 and secondary coils 34 and 36 is a band of flexible material 42 such as fiber-glass tape. The bands 42 are drawn tightly around the pairs of coils, holding them firmly against the upper and lower surfaces, respectively, of the upper and lower core legs 28. If it is desired to further improve the rigidity of the coils, spacers 44 of suitable material may be positioned between the adjacent peripheries of the coils of each pair so that the adjacent portions of the coils may also be held firmly against the lower and upper surfaces, respectively, of upper and lower horizontal core legs 28, see FIGS. 11 and 12. Means for further tightening the coils is indicated in FIGS. 11 and 12 and comprises driving a small wedge or wedges 46 between the lamination at the upper and lower surfaces of transformer core 24.

The foregoing described arrangement and construction of the aligned and spaced pairs of flat primary and secondary coils formed of aluminum strip which provides substantially improved coil rigidity and cooling are salient features of this invention. Relatively low cost aluminum strip suitable for the automated or semi-automated winding of transformer coils is relatively soft and flat coils formed thereof require some means to improve their rigidity. This is particularly so when the coils are spaced as described to improve heat dissipation, if they are to maintain their configuration under the conditions of vibration and heating incident to operation as arc welder transformer coils.

The welder casing 22 comprises front and rear panels 48 and 50, left and right side panels 52 and 54, and top and bottom panels 56 and 58, all suitably connected. The transformer assembly 10 is connected to and supported on front and rear casing panels 48 and 50 by angle members 60, which have one leg welded to the transformer core 24 and the other leg bolted to the casing panels by bolts 62. The arrangement is such that the exposed sides of the primary and secondary coils are parallel to the front and rear casing panels 48 and 50. The left and right side panels 52 and 54 are provided with upper and lower positioned louvers 64 and 66, repectively, and the cooling fan 20 is mounted adjacent the lower louver 66 and arranged to cause air to flow across the transformer coils parallel to the exposed sides thereof. Power switch 16 and output plug-in receptacle 18 are conveniently positioned on the front casing panel 48.

The vertical facing sides of the horizontally spaced pairs of primary of secondary transformer coils and the lower and upper surfaces, respectively, of the upper and lower horizontal legs 28 of the transformer core 24 define a rectangular window 68 through which an elongated horizontally arranged flux shunting member 70 of generally rectangular cross-sectional configuration is arranged to be reciprocated. The flux shunting member 70 is preferably formed by injection molding of a suitable, synthetic, plastic material and includes a laminated iron core 72 encapsulated in the right end portion thereof, see FIGS. 6 to 10. The laminations of iron core 72 are secured by rivets 73 and are arranged perpendicular to the laminations of transformer core 24. The laminations of shunting core 72 may, however, be arranged parallel with the laminations of transformer core 24, if desired.

Figure 7:
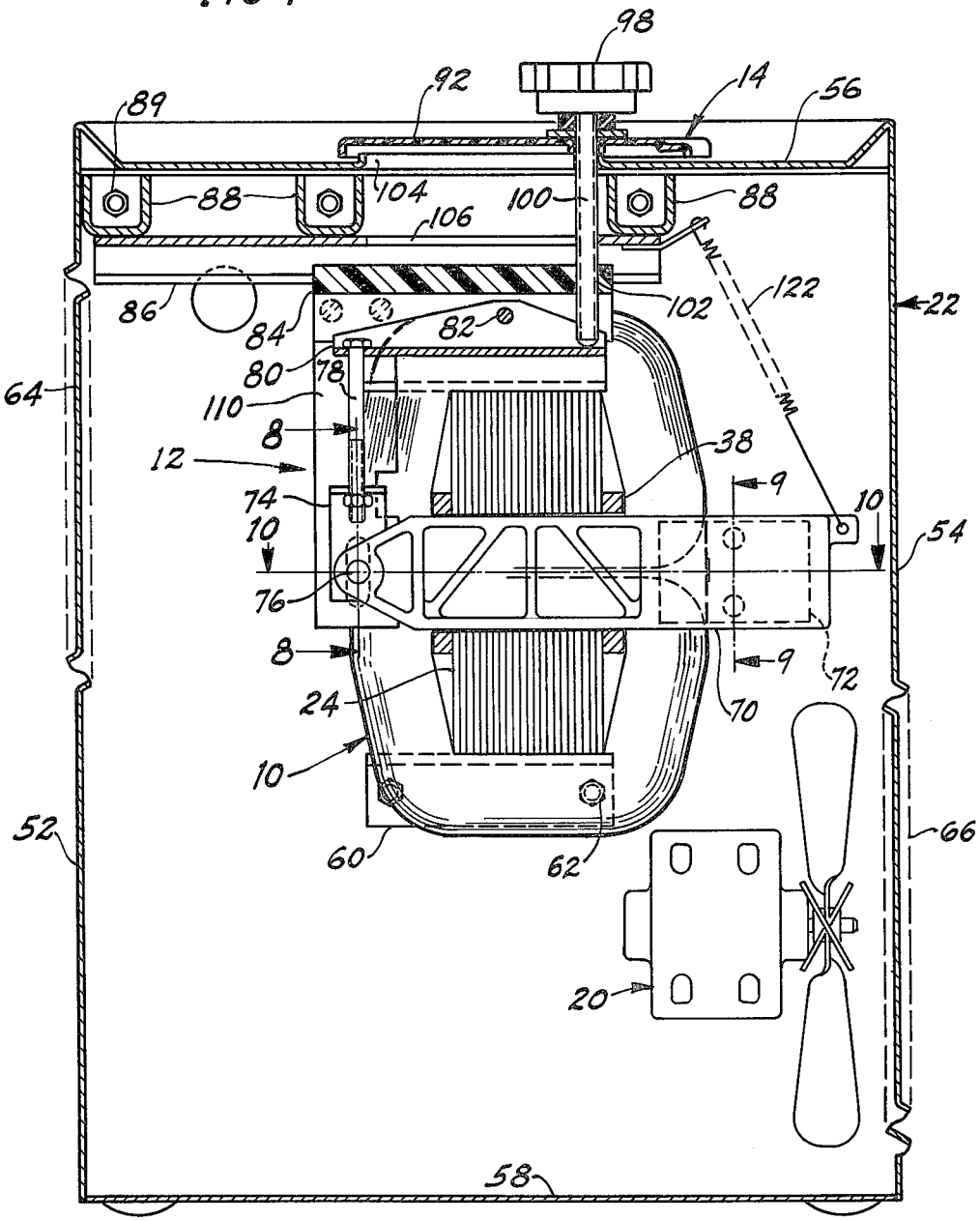
FIG. 7 is a cross-sectional view taken along line 7—7 of FIG. 6, looking from front to back.
Figure 9:
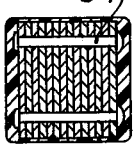
FIG. 9 is a transverse cross-sectional view through the laminated flux shunting member, showing the laminated iron core.
Figure 8:
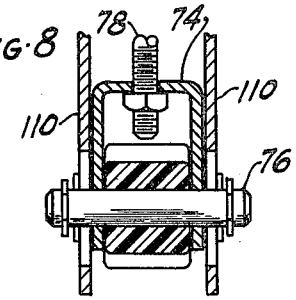
FIG. 8 is a fragmentary cross-sectional view taken along line 8—8 of FIG. 7.
Figure 10:
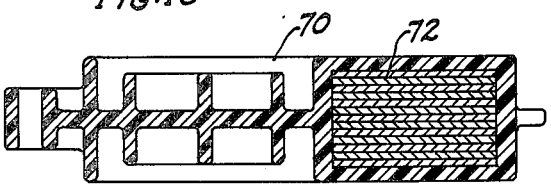
FIG. 10 is a longitudinal cross-sectional view of the flux shunting member taken along line 10—10 of FIG. 7.

Referring to FIG. 7, the length of reciprocating member 70 is such that a left end portion thereof extends beyond the left side of transformer core 24 when the right end portion thereof, which includes the encapsulated core 72, extends outward beyond the right side of transformer core 24. An inverted U-shaped member or clevice 74 is pivotally connected to the left end of member 70 by a pin 76 passing through the parallel legs of clevice 74 and through a horizontal bore through member 70. A vertical bolt connects clevice 74 to the left end of an above-positioned, horizontally arranged, U-shaped lever 80. Lever 80 is pivotally connected intermediate of its length by a bolt 82 to a horizontally elongated slide member 84. Slide member 84 is in turn supported and guided for horizontal reciprocation in a horizontally arranged guide track 86, which again in turn is welded to and supported by three horizontal channel members 88 bolted at their ends to casing side panels 48 and 50 immediately below the top casing panel 56 by bolts 89.

Pivotally mounted on the top casing panel 56 on a pivot 90 is a pointer member 92 having two radically spaced pointer elements 94 and 96 on an outer portion thereof arranged to sweep arcuately arranged indicia 95 and 97 as the pointer member 92 is oscillated on pivot 90. An operating knob 98 has attached thereto a downwardly extending vertical screw-threaded rod 100, see FIG. 7. Rod 100 passes through a clearance hole in pointer member 92, through a screw-threaded bore 102 in slide member 84, in which it is threadedly engaged and extends downward to abutment at its lower end with the right end of lever 80. The top casing panel 56 and guide track 86 are slotted at 104 and 106 to permit horizontal reciprocation of vertical rod 100, and the pointer member 92 is slotted radially at 108, see FIG. 1, to permit its rotation about pivot 90 as the rod 100 is reciprocated to cause the below-connected member 70 to be reciprocated through window 68. There is a pair of downwardly extending plate members 110 rigidly connected at their upper ends to the left end of the guided slide member 84, which plate members embrace the clevice 74 at their lower ends, see FIGS. 7 and 8, to restrain the clevice and the attached flux shunting member 70 against lateral movement.

TRANSFORMED WITH DUAL RANGE OUTPUT

Figure 13:
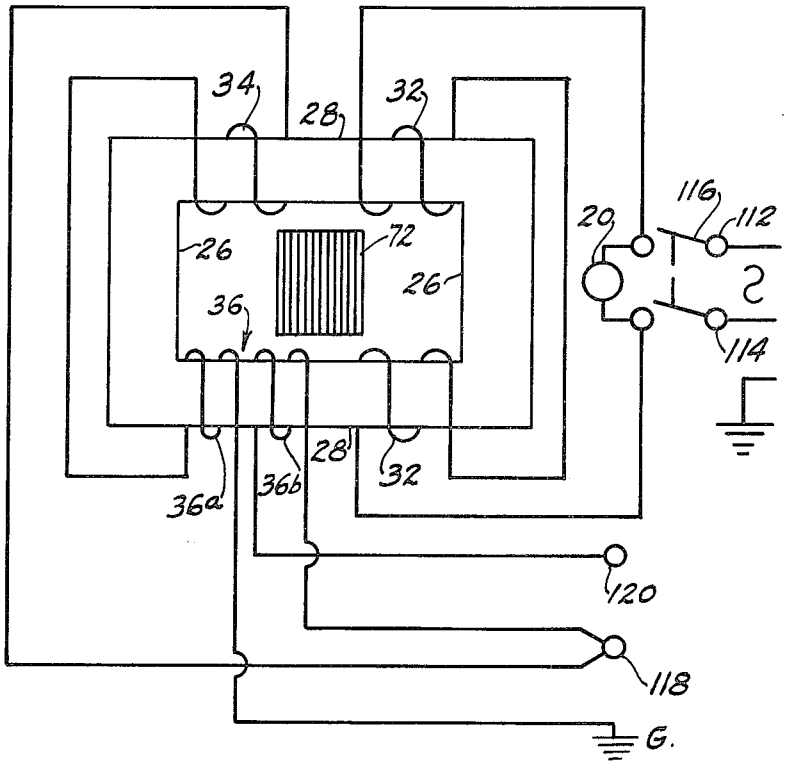
FIG. 13 is a circuit diagram of the transformer having dual output range.

The circuit diagram, FIG. 13, illustrates the arrangement and connection of the primary and secondary transformer coils. Primary coils 32 are connected in series across a.c. supply terminals 112 and 114 through the power switch 16. The cooling fan 20 is connected in parallel with primary coils 32 through switch 16. Secondary coil 34 and the outer winding **36*a* of composite secondary coil 36 are series connected between a high output range plug-in terminal 118 and ground "G", which is the workpiece being welded. The inner (reactor) winding 36b of the composite secondary coil 36 is connected in series with the secondary coil 34 and the outer winding 36a of secondary coil 36 between a low output plug-in terminal 120** and ground G.

OPERATION OF THE FLUX SHUNTING MEMBER

Stepless variation in current output throughout ranges extending downward from the maximum output at high output terminal 118 and low output terminal 120 is achieved by moving the flux shunting member 70 and the encapsulated iron core 72 horizontally toward the left, in FIG. 7, into the window 68, defined by upper and lower horizontally core legs 28 and the spaced facing sides of primary coils 32 and secondary coils 34 and 36. The flux shunting member 70 is shown in FIG. 7 in a locked, rightwardly extended, non-shunting position. In this locked position, the knob 98 has been rotated, causing the lower end of rod 100, which is screw threadedly engaged in slide member 84, to apply a downward force to the right end of lever 80. This causes the left end of member 70 to be pulled upward by connecting bolt 78, clevice 74, and pivot pin 76 to a slightly misaligned position. In this position, an upper surface portion of member 70 bears against the leftward portion of the lower surface of upper core leg 28, and a lower surface portion of member 70 bears against a rightward portion of the upper surface of lower core leg 28, thereby locking member 70 against movement.

The difference between the vertical dimension of member 70 and the space between the lower and upper core legs 28 is such that while permitting free reciprocation of member 70 therebetween, when released, yet provides firm retention of member 70 against vibration when in the misaligned, locked position. To preclude excessive lateral movement of the rightward portion of member 70, suitable spacing insulation between the sides of member 70 and the facing surfaces of the coils may be provided.

When it is desired to reduce the output at either the high output terminal 118 or the low output terminal 120, the knob 98 is rotated in a direction to release the downward force applied to the right end of lever 80 by rod 100. When this occurs a spring 122 attached to the right end of member 70 assists in releasing and aligning member 70 in the window 68 for free slidable movement. The knob 98 and attached rod 100 are then moved linearly toward the left along the slots 104 and 106. Leftward movement of knob 98 causes the whole assembly to be moved, with the iron core 72 entering the window 68 to some partial flux shunting position. As the knob 98 and rod 100 are moved leftward, the pointer 92 is caused to rotate counterclockwise to a lower output indicating position. When the pointer has been moved to the desired output as designated on either low or high range scales 95 or 97, the knob is again rotated in a direction to lock member 70 in that position.

MODIFIED FORM OF TRANSFORMER WITH THREE RANGES OF OUTPUT

Figure 14:
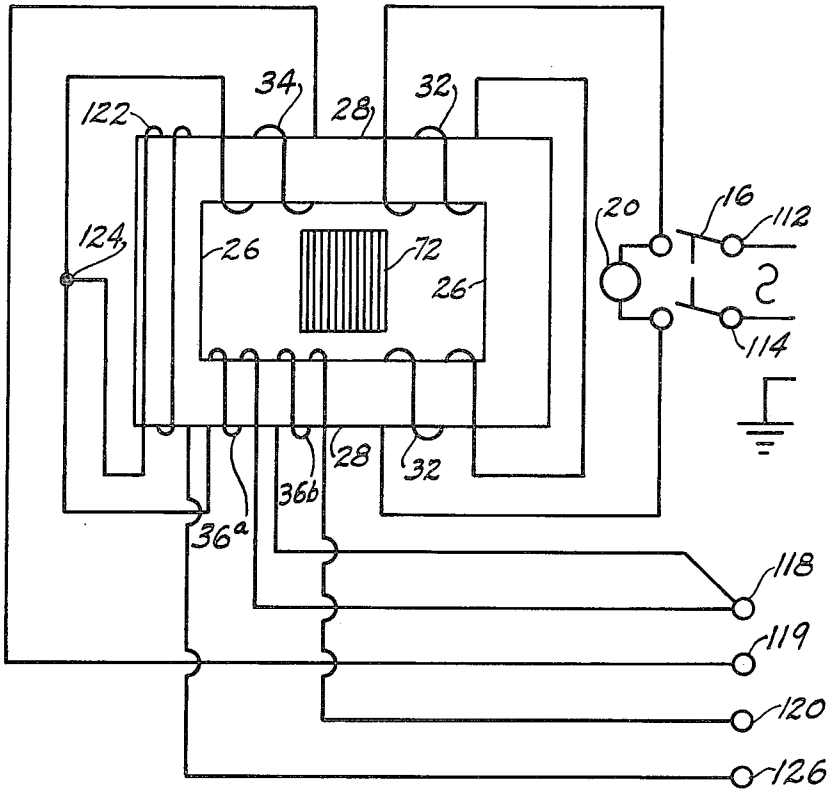
FIG. 14 is a circuit diagram of a transformer having three output ranges.

The circuit diagram, FIG. 14, illustrates a modified form of the transformer shown in FIGS. 6, 7, and 10 to 13, which modified form provides a third current output range. The transformer of FIG. 14 is similar to that shown in FIG. 13 except for the addition of a choke coil 122 and such changes in the dimensions of the aluminum strip and the number of turns thereof required in the primary and secondary coils to attain the three output ranges. The choke coil 122 is connected at one end to a point 124 between the secondary coil 34 and the outer winding 36*a* and composite secondary coil 36 and at its other end to an output terminal 126.

In FIG. 14, the secondary coil 34 and outer winding 36*a* of secondary coil 36 are series connected between output terminal 118 and an output terminal 119 to obtain the highest output range, and both inner and outer windings 36*a* and 36*b* of coil 36 are connected in series with coil 34 between an output terminal 120 and output terminal 119 to obtain an intermediate output range. To obtain the lowest output range, the choke coil 122 is connected to series with both inner and outer windings 36*a* and 36*b* of coil 36 between output terminal 120 and output terminal 126.

In the modified form of FIG. 14, two, detachable cables are employed for selectively connecting a welding electrode and a workpiece to be welded to the output terminals 118, 119. 120, and 126. To obtain the highest range, on cable is employed to connect output terminal 118 to a welding electrode and the other cable is employed to connect output terminal 119 to the workpiece to be welded. To obtain the intermediate output range, one detachable cable connects output terminal 120 to a workpiece. To obtain the lowest output range, one cable connects output terminal 120 to a welding electrode and the other cable connects output terminal 126 to the workpiece.

Figure 5:
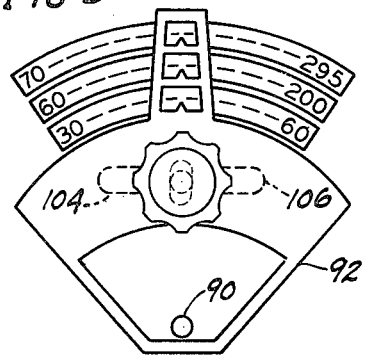
FIGS. 4 and 5 are top plan views showing the arrangement of selector plate indicia, pointer means, and operating knob employed with arc welders constructed in accordance with the present invention and having two and three ranges of current output.
Figure 4:
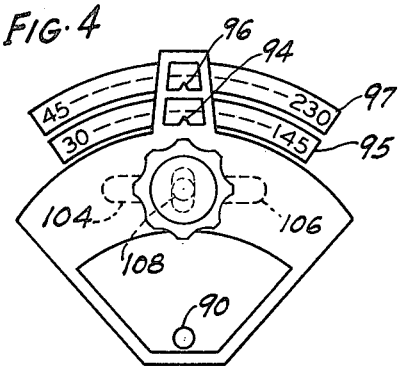
Figure 2:
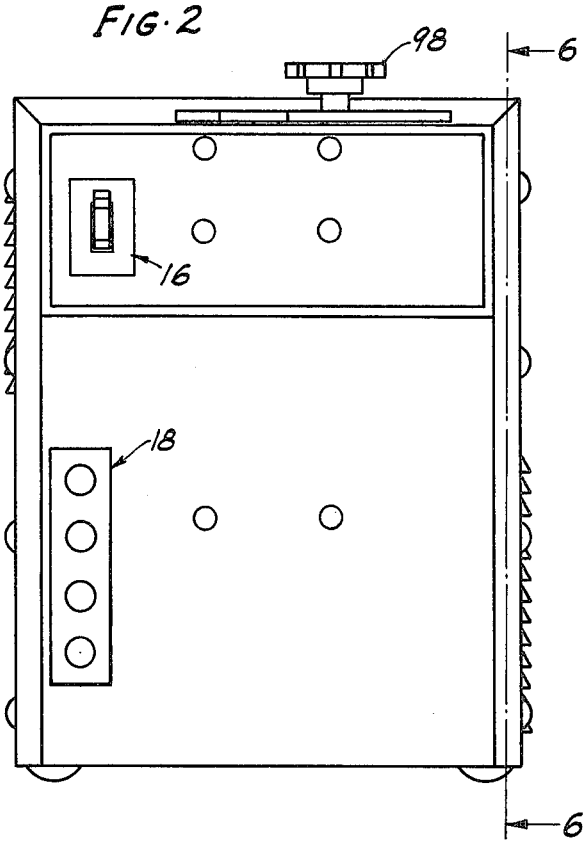
Figure 3:
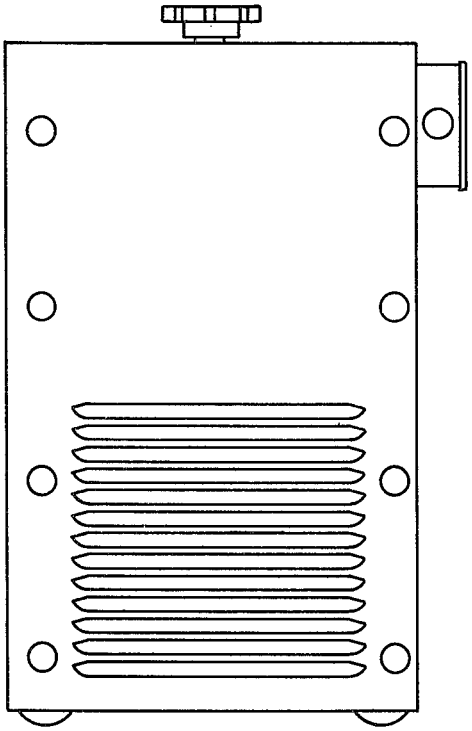

The choke coil 122 is preferably formed of round wire and wound around any suitable portion of the core outside of the window 30. The pointer 92 and indicia shown in FIG. 5 are employed when the transformer illustrated in FIG. 4, having three output ranges, is employed.

The foregoing description is intended to be illustrative and not limiting, the scope of the invention being set forth in the appended claims.

We claim:

1. In an a.c. arc welder, a transformer having an iron core comprising a flat frame defining a window, primary and secondary coil means wound on said frame, an elongated non-metallic flux shunting member carrying an iron flux shunting core at one end thereof extending through said window perpendicular to said frame, said elongated member being freely slidable longitudinally between two opposed surface portions of said frame extending in parallel through said window when said member is substantially perpendicular to said frame, but being firmly locked against movement when forcibly tilted so as to bind between said surface portions, an elongated fixed guide spaced laterally from said window and extending perpendicular to said flat frame, a slidably mounted member constrained to slidable movement in said guide, means connecting said slidably mounted member to one end of said flux shunting member including force multiplying means operation to forcibly tilt said flux shunting member to a locked position when moved in one direction and operative to release it when moved oppositely, and a handle connected to said slidably mounted member for moving said flux shunting member longitudinally in said window.

2. The a.c. arc welder claimed in claim 1 in which said means connecting said slidably mounted member to one end of said flux shunting member includes a screw-threaded member operative to forcibly tilt said flux shunting member to a locked position when rotated in one direction and operative to release it when rotated oppositely, and a handle on said screw-threaded member for rotating it and for moving said flux shunting member longitudinally in said window when in a released condition.

3. The a.c. arc welder claimed in claim 1 in which said elongated flux shunting member is constructed of a synthetic plastic material and in which said iron flux shunting core carried at one end of said member is encapsulated in said plastic material.

4. The a.c. arc welder claimed in claim 3 in which said slidably mounted member is connected to the other end of said elongated flux shunting member and in which spring means connected to said one end of said member biases said member toward a released position.

5. The a.c. arc welder claimed in claim 1 which includes pointer means movable with said slidably mounted member along a scale indicating the position of said iron flux shunting core relative to said window in terms of current output of said secondary coil means.

6.

In an a.c. arc welder, a transformer having an iron core comprises a vertically arranged rectangular frame with opposed horizontal and vertical legs defining a rectangular window, a pair of primary coils, one wound on each of said opposed horizontal legs in vertical alignment and adjacent one vertical leg, and a pair of secondary coils, one wound on each of said opposed horizontal legs in vertical alignment and adjacent the other vertical leg, said horizontal core legs and the adjacent vertical faces of said pairs of coils defining a smaller rectangular window, an elongated flux shunting member of non-metalic material carrying an iron flux shunting core at one end extending horizontally through said smaller window, the fit of said member between said horizontal core legs being such that said member is freely movable between said horizontal legs when in a substantially horizontal position, but is firmly locked against movement between said horizontal core lets when forcibly tilted from a horizontal position, and screw-threaded means connected to one end of said shunting member and operative when rotated in one direction to forcibly tilt said member to a locked position and when rotated oppositely to release it.

7. In an arc welder, a transformer having a laminated core including a pair of spaced, parallel, and coextending legs, a pair of flat primary coils of flat aluminum strip one wound on each of said core legs and in alignment, a pair of flat secondary coils of flat aluminum strip one wound on each of said core legs and in alignment, said pairs of aligned coils being spaced along said core legs, a flexible band tightly encircling each of said pairs of coils, and a flux shunting core mounted for reciprocation between said core legs and between the adjacent faces of said spaced pairs of coils.

8. The arc welder claimed in claim 7 in which a spacer of suitable material is interposed between adjacent peripheral portions of the coils of at least one of said pairs of aligned coils to hold the adjacent portions of said coils tightly against said spaced core legs.

9. The arc welder claimed in claim 7 in which said coils are wound perpendicular to the laminations of said core and in which wedging elements are inserted between laminations adjacent said coils to further tighten the windings thereof.

10. The arc welder claimed in claim 7 in which said pair of primary coils are series connected across an a.c. power source, in which one of the secondary coils of said pair comprises an inner and an outer winding, in which the other of said secondary coils of said pair is connected in series with one of said windings of said one secondary coil to provide a first high current output, and in which the said other secondary coil is connected in series with both said inner and outer windings of said one secondary coil to provide a second, lower, current output.

* * * * *